United States Patent [19]

Fallotico

[11] 3,932,019

[45] Jan. 13, 1976

[54] JACK TYPE ADAPTOR

[76] Inventor: John Fallotico, 39 Yahara Ave., Rutherford, N.J. 07070

[22] Filed: July 18, 1974

[21] Appl. No.: 489,784

[52] U.S. Cl...... 339/176 M; 339/185 R; 339/198 P

[51] Int. Cl.$^2$..... H01R 13/50

[58] Field of Search..... 339/135, 176 R, 176 M, 339/185 R, 198 S, 198 P

[56] References Cited

UNITED STATES PATENTS

| | | | |
|---|---|---|---|
| 2,047,384 | 7/1936 | Richterkessing | 339/185 R |
| 3,184,702 | 5/1965 | Tenniswood | 339/176 |
| 3,519,977 | 7/1970 | Swearingen | 339/185 R |

FOREIGN PATENTS OR APPLICATIONS

| | | | |
|---|---|---|---|
| B28,019 | 2/1956 | Germany | 339/176 R |

*Primary Examiner*—Roy Lake
*Assistant Examiner*—Mark S. Bicks
*Attorney, Agent, or Firm*—Daniel Jay Tick

[57] ABSTRACT

A jack type adaptor for electrically connecting an electric light fixture to an electric box comprises a jack type connecting member for mechanical connection to an electric box. The jack type connecting member comprises a first U-shaped bracket device and a pair of jack type connecting devices affixed to the bracket device in spaced parallel relation and electrically connected to electrically conductive leads in the electric box. A plug type connecting member for mechanical connection to a light fixture comprises a second U-shaped device and a pair of plug type connecting devices affixed to the second device in spaced parallel relation and electrically connected to the electrically conductive leads of the light fixture. The plug type connecting member is of the same configuration as the jack type connecting member but of larger dimensions to permit the juxtaposition of the plug type connecting member on the jack type connecting member with the plug type connecting devices in electrical contact with the corresponding jack type connecting devices thereby electrically connecting the light fixture to the leads in the box.

3 Claims, 6 Drawing Figures

FIG. 4
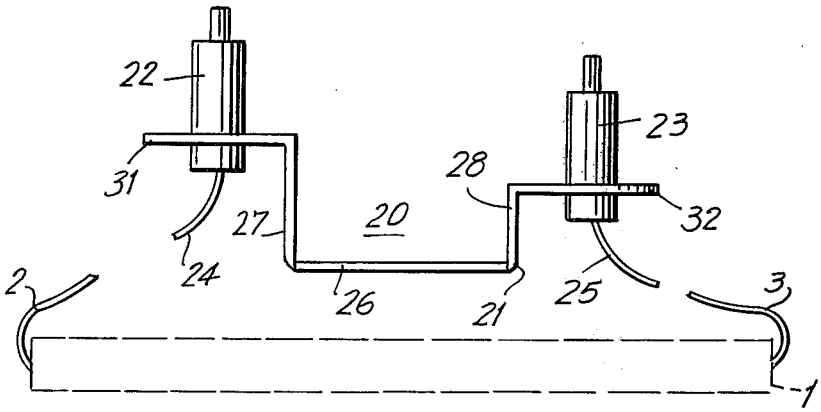
FIG. 5
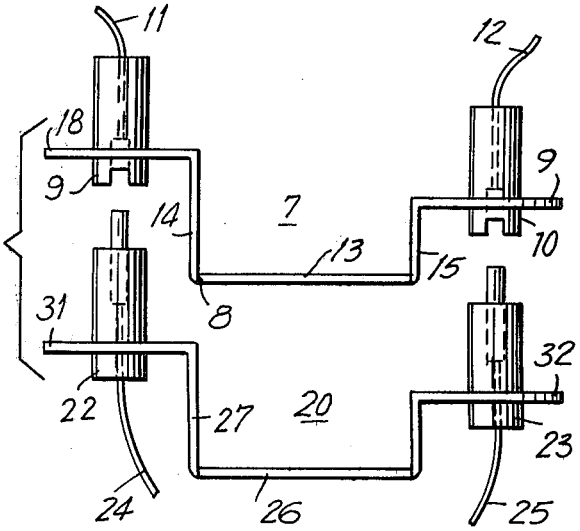
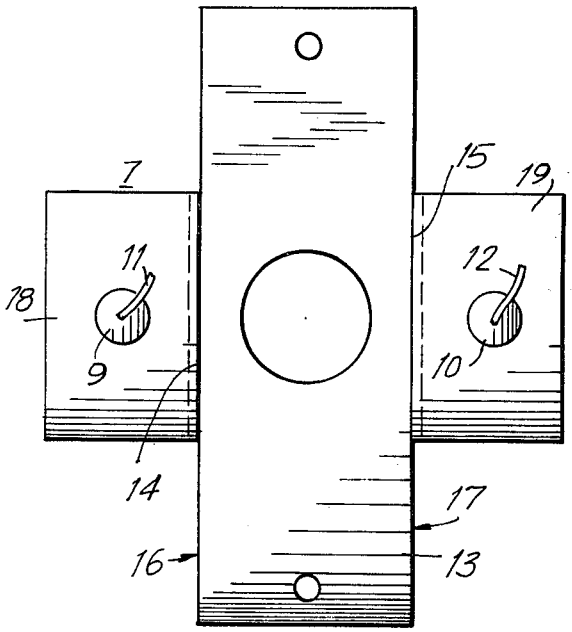
FIG. 6

JACK TYPE ADAPTOR

BACKGROUND OF THE INVENTION

The present invention relates to a jack type adaptor. More particularly, the invention relates to a jack type adaptor for electrically connecting an electric light fixture to an electric box.

When a person desires to connect an electric light fixture to an electric box in a ceiling or wall, it is necessary to connect the electrically conductive leads of the light fixture to the proper leads of the electric box. This involves disconnecting the source of electrical energy by opening the circuit before attempting the operation. It also involves splicing the electrical leads in a proper manner. The operation is too complicated for many people, so that they ultimately utilize the services of an electrician. Furthermore, there is always a strong possibility of an amateur getting an electric shock when attempting to make the connection himself and in many cases short-circuiting the line by making the wrong connections and thereby losing electric power altogether.

The principal object of the invention is to provide a jack type adaptor for electrically connecting an electric light fixture to an electric box, which adaptor is installed with complete safety, rapidity, comfort and convenience by people with or without skill.

An object of the invention is to provide a jack type adaptor of simple structure, which functions efficiently, effectively and reliably to electrically connect an electric light fixture to an electric box.

Another object of the invention is to provide a jack type adaptor for electrically connecting an electric light fixture to an electric box by connecting the leads of the electrical fixture to the proper leads of the electric box without conscious effort on the part of the person making the installation.

Still another object of the invention is to provide a jack type adaptor for electrically connecting an electric light fixture to an electric box without opening a circuit and without any shock to the person making the installation.

Yet another object of the invention is to provide a jack type adaptor for electrically connecting an electric light fixture to an electric box without the need for splicing leads and without the possibility of short-circuiting the line.

BRIEF SUMMARY OF THE INVENTION

In accordance with the invention, a jack type adaptor electrically connects an electric light fixture to an electric box, the light fixture having electrically conductive leads for energizing the light fixture and the electric box having electrically conductive leads therein. The adaptor comprises a jack type connecting member for mechanical connection to an electric box. The jack type connecting member comprises a first substantially U-shaped bracket device and a pair of jack type connecting devices affixed to the bracket device in spaced substantially parallel relation and electrically connected to the electrically conductive leads in the electric box. A plug type connecting member for mechanical connection to a light fixture comprises a second substantially U-shaped device and a pair of plug type connecting devices affixed to the second device in spaced substantially parallel relation and electrically connected to the electrically conductive leads of the light fixture. The plug type connecting member is of the same general configuration as the jack type connecting member, but of larger dimensions, to permit the juxtaposition of the plug type connecting member on a jack type connecting member with the plug type connecting devices in electrical contact with the corresponding jack type connecting devices thereby electrically connecting the light fixture to the leads in the box.

The jack type connecting member comprises a first substantially planar bracket plate. A first pair of side members extend substantially perpendicularly from the first bracket plate along part of opposite edges thereof. Each of a first pair of head members extends substantially perpendicularly from a corresponding one of the first pair of side members at the free edge thereof and substantially parallel to the first bracket plate. Each of the head members of the first pair of head members extends away from the side member of the other member. Each of a pair of jack type connecting devices is affixed to and extends substantially perpendicularly from a corresponding one of the head members of the first pair of head members. Each of the jack type connecting devices extends toward the first bracket plate. Each of the head members of the first pair of head members has a hole formed therethrough for accommodating the corresponding one of the jack type affixed thereto.

The plug type connecting member comprises a substantially planar base member. A second pair of side members extend substantially perpendicularly from the base member along opposite edges thereof. Each of a second pair of head members extends substantially perpendicularly from a corresponding one of the second pair of side members at the free edge thereof and substantially parallel to the base member. Each of the head members of the second pair of head members extends away from the side member of the other head member. Each of a pair of plug type connecting devices is affixed to, and extends substantially perpendicularly from, a corresponding one of the head members of the second pair of head members. Each of the plug type connecting devices extends away from the base member. Each of the head members of the second pair of head members has a hole formed therethrough for accommodating the corresponding one of the plug type connecting devices affixed thereto.

One of the first pair of side members extends a greater distance from the first bracket plate than the other and the corresponding one of the second pair of side members extends a greater distance from the base member than the other. Thus, each of the plug type connecting devices is electrically connectable only with the corresponding one of the jack type connecting devices.

BRIEF DESCRIPTION OF THE DRAWINGS

In order that the invention may be readily carried into effect, it will now be described with reference to the accompanying drawing, wherein:

FIG. 4 is an end view, taken along the lines IV—IV, of FIG. 3;

FIG. 5 is an end view of the embodiments of FIGS. 2 and 4 illustrating their connectability with each other; and FIG. 6 is a view taken along the lines VI—VI, of FIG. 2.

In the FIGS., the same components are identified by the same reference numerals.

DETAILED DESCRIPTION OF THE INVENTION

Figure 2:
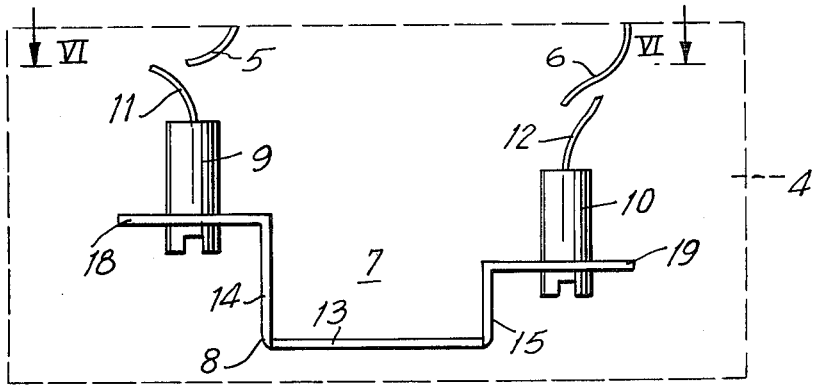
FIG. 2 is an end view, taken along the lines II—II, of FIG. 1.

The jack type adaptor of the invention is for electrically connecting an electric light fixture 1, illustrated by broken lines in FIG. 4, and having electrically conductive leads 2 and 3, to an electric box 4, illustrated by broken lines in FIG. 2, and having electrically conductive leads 5 and 6 for energizing the light fixture.

The jack type adaptor of the invention comprises a jack type connecting member 7 (FIGS. 1, 2, 5 and 6) for mechanical connection to the electric box 4, as illustrated in FIG. 2. The jack type connecting member 7 comprises a first substantially U-shaped bracket device 8 and a pair of jack type connecting devices 9 and 10 (FIGS. 1, 2, 5 and 6) affixed to the bracket device in spaced substantially parallel relation. The jack type connecting devices 9 and 10 are electrically connected to the electrically conductive leads 5 and 6 in the electric box 4 via electrically conductive leads 11 and 12, respectively, of said jack type connecting devices. Although the actual electrical connection of the leads is not shown in the FIG. 2, such electrical connections are made by any suitable means.

Figure 1:
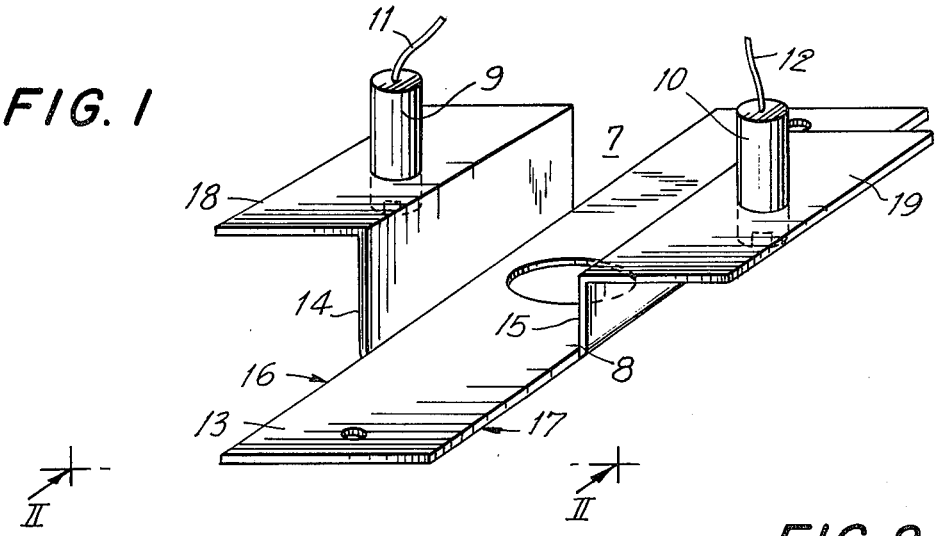
FIG. 1 is a schematic diagram of an embodiment of the jack type connecting member of the jack type adaptor of the invention.

The jack type connecting member 7, and more particularly, the bracket device 8 thereof, as shown in FIGS. 1, 2 and 5, comprises a first substantially planar bracket plate 13. A first pair of side members 14 and 15 extend substantially perpendicularly from the first bracket plate 13 along part of opposite edges 16 and 17 (FIG. 1) thereof, respectively. A first pair of head members 18 and 19 are provided. Each of the head members 18 and 19 extends substantially perpendicularly from a corresponding one of the first pair of side members 14 and 15, respectively, at the free edge thereof and substantially parallel to the first bracket plate 13, as shown in FIGS. 1, 2 and 5. Each of the head members 18 and 19 extend away from the side member 14 and 15 of the other head member. In other words, the head member 18 extends away from the side member 15 and the head member 19 extends away from the side member 14.

Each of the pair of jack type connecting devices 9 and 10 is affixed to and extends substantially perpendicularly from a corresponding one of the head members 18 and 19. Thus, the jack type connecting device 9 is affixed to the head member 18 and extends toward the first bracket plate 13. The jack type connecting device 10 is affixed to the head member 19 and extends toward the first bracket plate 13. Each of the head members 18 and 19 has a hole formed therethrough for accommodating the corresponding one of the jack type connecting devices affixed thereto.

Figure 3:
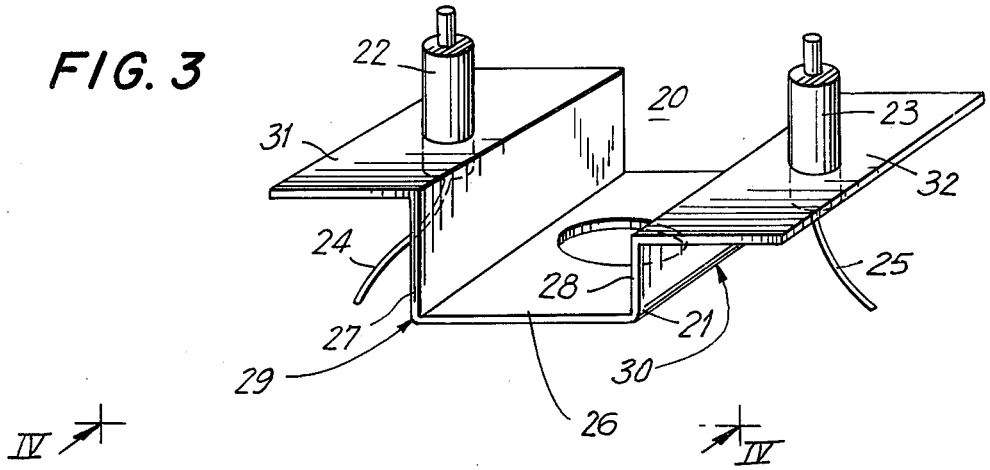
FIG. 3 is a schematic diagram of an embodiment of the plug type connecting member of the jack type adaptor of the invention.

The jack type adaptor of the invention further comprises a plug type connecting member 20 (FIGS. 3, 4 and 5), mechanically connected to the light fixture 1. The plug type connecting member 20, as shown in FIGS. 3, 4 and 5, comprises a second substantially U-shaped device 21 and a pair of plug type connecting devices 22 and 23 affixed to the second device in spaced substantially parallel relation. The plug type connecting devices 22 and 23 are electrically connected to the electrically conductive leads 2 and 3 of the light fixture 1 via electrically conductive leads 24 and 25, respectively, of said plug type connecting devices. Although the actual electrical connection of the leads is not shown in the FIGS., such electrical connections are made by any suitable means.

The plug type connecting member is of the same general configuration as the jack type connecting member 7, but of larger dimensions, to permit the juxtaposition of the plug type connection member 20 on the jack type connecting member with the plug type connecting devices 22 and 23 in electrical contact with the corresponding jack type connecting devices 9 and 10, as illustrated in FIG. 5, thereby electrically connecting the light fixture 1 to the leads 5 and 6 in the electric box 4.

The plug type connecting member 20, and more particularly, the device 21 thereof, as shown in FIGS. 3, 4 and 5, comprises a base member 26. A second pair of side members 27 and 28 extend substantially perpendicularly from the base member 26 along part of opposite edges 29 and 30 (FIG. 3) thereof, respectively. A second pair of head members 31 and 32 are provided. Each of the head members 31 and 32 extends substantially perpendicularly from a corresponding one of the second pair of side members 27 and 28, respectively, at the free edge thereof and substantially parallel to the second bracket plate 26, as shown in FIGS. 3, 4 and 5. Each of the head members 31 and 32 extends away from the side member 27 and 28 of the other head member. In other words, the head member 31 extends away from the side member 28 and the head member 32 extends away from the side member 27.

Each of the plug type connecting devices 22 and 23 is affixed to and extends substantially perpendicularly from a corresponding one of the head members 31 and 32. Thus, the plug type connecting device 22 is affixed to the head member 31 and extends away from the base member 26. The plug type connecting device 23 is affixed to the head member 32 and extends away from the base member 26. Each of the head members 31 and 32 has a hole formed therethrough for accommodating the corresponding one of the plug type connecting devices affixed thereto.

The side member 14 of the first pair of side members 14 and 15 extends a greater distance from the first bracket plate 13 than does the side member 15. The side member 27 of the second pair of side members 27 and 28 extends a greater distance from the base member 26 than does the side member 28. Thus, error in connection or installation on the part of the person installing the adaptor of the invention is precluded. Each of the plug type connecting devices 22 and 23 is electrically connectable only with the corresponding one of the jack type connecting devices 9 and 10. That is, the plug type connecting device 22 may only be electrically connected to the jack type connecting device 9 and the plug type connecting device 23 can only be connected to the jack type connecting device 10. If the person installing the adaptor of the invention were to attempt to make the installation in the reverse fashion, there would be no connection between one of the plug type connecting devices and one of the jack type connecting devices, so that there would be an open circuit.

While the invention has been described by means of a specific example and in a specific embodiment, I do not wish to be limited thereto, for obvious modifications will occur to those skilled in the art without departing from the spirit and scope of the invention.

I claim:

1. A jack type adaptor for electrically connecting an electric light fixture to an electric box, the light fixture having electrically conductive leads for energizing said light fixture and the electric box having electrically conductive leads therein, said adaptor comprising a jack type connecting member for mechanical connection to an electric box, said jack type connecting member comprising a first substantially U-shaped bracket device and a pair of jack type connecting devices affixed to the bracket device in spaced substantially parallel relation and electrically connected to the electrically conductive leads in the electric box, the jack type connecting member comprising a first substantially planar bracket plate, a first pair of side members extending substantially perpendicularly from the first bracket plate along part of opposite edges thereof, a first pair of head members each extending substantially perpendicularly from a corresponding one of the first pair of side members at the free edge thereof and substantially parallel to the first bracket plate, each of the head members of the first pair of head members extending away from the side member of the other head member, and a pair of jack type connecting devices each affixed to and extending substantially perpendicularly from a corresponding one of the head members of the first pair of head members, each of the jack type connecting devices extending toward the first bracket plate, each of the head members of the first pair of head members having a hole formed therethrough for accommodating the corresponding one of the jack type connecting devices affixed thereto; and a plug type connecting member for mechanical connection to a light fixture, said plug type connecting member comprising a second substantially U-shaped device and a pair of plug type connecting devices affixed to the second device in spaced substantially parallel relation and electrically connected to the electrically conductive leads of the light fixture, the plug type connecting member being of the same general configuration as the jack type connecting member but of larger dimensions to permit the juxtaposition of the plug type connecting member on the jack type connecting member with the plug type connecting devices in electrical contact with the corresponding jack type connecting devices thereby electrically connecting the light fixture to the leads in the box.

2. A jack type adaptor as claimed in claim 1, wherein the plug type connecting member comprises a substantially planar base member, a second pair of side members extending substantially perpendicularly from the base member along opposite edges thereof, a second pair of head members each extending substantially perpendicularly from a corresponding one of the second pair of side members at the free edge thereof and substantially parallel to the base member, each of the head members of the second pair of head members extending away from the side member of the other head member, and a pair of plug type connecting devices each affixed to and extending substantially perpendicularly from a corresponding one of the head members of the second pair of head members, each of the plug type connecting devices extending away from the base member, each of the head members of the second pair of head members having a hole formed therethrough for accommodating the corresponding one of the plug type connecting devices affixed thereto.

3. A jack type adaptor as claimed in claim 2, wherein one of the first pair of side members extends a greater distance from the first bracket plate than the other and the corresponding one of the second pair of side members extends a greater distance from the base member than the other, so that each of the plug type connecting devices is electrically connectable only with the corresponding one of the jack type connecting devices.

* * * * *